United States Patent [19]

Giblin et al.

[11] Patent Number: 5,015,037

[45] Date of Patent: May 14, 1991

[54] CHAIR ASSEMBLY HAVING NON-SLIP SEAT

[76] Inventors: Elizabeth Giblin; Jay P. Giblin, both of 85 Bradley Ave., Meriden, Conn. 06450

[21] Appl. No.: 442,163

[22] Filed: Nov. 28, 1989

[51] Int. Cl.[5] ..... A47C 7/02

[52] U.S. Cl. ..... 297/452; 297/DIG. 2; 297/219

[58] Field of Search ..... 297/218, 382, 452, DIG. 2, 297/219; 248/346; 428/205; 106/36; 4/582, 583

[56] References Cited

U.S. PATENT DOCUMENTS

| | | | |
|---|---|---|---|
| D. 117,862 | 11/1939 | Bayer . | |
| D. 262,590 | 1/1982 | Trotman et al. . | |
| 1,539,159 | 5/1925 | Cobel | 297/219 X |
| 2,791,268 | 5/1957 | Mendelsohn . | |
| 2,931,427 | 4/1960 | Goldstein . | |
| 3,323,151 | 6/1967 | Lerman | 297/382 X |
| 3,381,999 | 5/1968 | Steere, Jr. . | |
| 3,604,442 | 4/1887 | Hyde et al. . | |
| 4,147,828 | 4/1979 | Heckel et al. . | |
| 4,164,798 | 8/1979 | Weber . | |
| 4,326,006 | 4/1982 | Kaminstein | 428/205 X |
| 4,518,164 | 5/1985 | Hayford, Jr. | 248/346 X |
| 4,536,906 | 8/1985 | Varndell et al. . | |
| 4,686,724 | 8/1987 | Bedford . | |

*Primary Examiner*—Peter A. Aschenbrenner
*Attorney, Agent, or Firm*—Ira S. Dorman

[57] ABSTRACT

An assembly of a highchair having a smooth seat, and a thin, flat, compliant pad freely covering the seat surface. The pad is made from one piece of solid, rubbery material providing a high coefficeint of friction, and it has a matrix of apertures formed through it, each defined by a sharp peripheral edge at its juncture with the faces of the pad. The pad conforms to the seat in an anti-slip relationship, and it provides good mechanical interengagement with the diaper or garment of a baby seated upon it, despite the lightness of the baby's body.

13 Claims, 1 Drawing Sheet

CHAIR ASSEMBLY HAVING NON-SLIP SEAT

BACKGROUND OF THE INVENTION

Because of inadequate resistance, there is a substantial tendency for babies and young children seated in highchairs to slip downwardly in the seat, and sometimes to fall from the highchair as a result. The resultant movement is not only inconvenient, during feeding for example, but more importantly it subjects the child to discomfort and ultimately to the risk of serious injury.

Regardless of whether they are made of wood, plastic or metal, highchair seats virtually always have smooth surfaces, and hence offer little resistance to slippage of cloth or plastic thereover, as on diapers or clothing. Friction can of course be further diminished by wetness o contamination, as will often result from food and drink spills, or the like.

Difficulties similar to the foregoing are also experienced by seated adults who are infirm or for other reasons unable to maintain an erect seated posture.

Cushions and pads having anti-slip characteristics have previously been disclosed in the art. For example, Bedford U.S. Pat. No. 4,686,724 provides an open-cell foam pad having air-flow channels, said to function to dissipate excess body fluids or medicines. Various forms of seat cushions having apertures are disclosed in Hyde & Seaman U.S. Pat. No. 360,442, in Goldstein U.S. Pat. No. 2,931,427, in Steere, Jr. U.S. Pat. No. 3,381,999, and in Trotman et al United States Design patent U.S. Pat. No. 262,590. Heckel et al U.S. Pat. No. 4,147,828, showing an exercise mat that includes a sheet or net of non-skid rubber or synthetic material, Varndell et al U.S. Pat. No. 4,536,906, and Bauer United States Design patent U.S. Pat. No. 117,862, are also of interest with respect to cushion and pad constructions.

Despite the activity in the art indicated by the foregoing, a need remains for simple and inexpensive means for counteracting the tendency for occupants of chairs, and in particular for babies in highchairs, to slip from an upright seated position, which means is readily assembled and disassembled and easy to use and clean, and is yet durable and effective for its intended purposes. Consequently, it is the object of the present invention to provide such means.

SUMMARY OF THE INVENTION

It has now been found that the foregoing and related objects of the invention are readily attained by the provision of a chair assembly comprising, in combination, a chair including a seat portion having a smooth upper surface, and a thin, flat, compliant pad dimensioned and configured to lie freely upon, and to substantially cover, the surface of the chair seat portion. The pad is about 0.06 to 0.125 inch thick, and is integrally formed, as a single piece, from a solid, rubbery material having a durometer value of about 30 to 50, and preferably about 40, a tensile strength of at least about 2000 pounds per square inch, and a coefficient of friction having a value of at leas& about unity, as determined against a smooth surface of wood. An array of apertures is formed through, and substantially entirely over, the pad; each aperture is defined by a sharp peripheral edge at its juncture with at least one of the faces of the pad, and provides an opening with an area about 0.05 to 0.3 square inch. Cumulatively, the apertures define an open area that constitutes about 20 to 30, and preferably about 24 to 25, percent of the total projected pad area.

The pad inherently exhibits a high level of conformability to, and slip resistance with, the seat portion surface of the chair; it has good mechanical interengagability with supple members pressed upon its upper face, and good strength and durability characteristics.

The apertures formed through the pad will usually be round holes, about 0.25 to 0.625, and preferably 0.375 to 0.5 inch in diameter, equidistantly spaced from one another on perpendicular axes to provide a rectangular matrix, and typically on centers of about 0.75 inch. The rubbery material of which the pad is fabricated will most desirably have a durometer value of about 40, a tensile strength not in excess of about 4000 pounds per square inch, and a coefficient of friction of at least about 1.2, determined as previously indicated. In most instances, the pad will be of generally rectangular configuration, measuring about 9.5 to 12 inches by 11 to 13 inches on edge, and the material employed will most advantageously be a neoprene rubber.

The objects of the invention are also attained by the provision of a pad having the features and structure herein described.

DETAILED DESCRIPTION OF THE PREFERRED AND ILLUSTRATED EMBODIMENT

Figure 1:
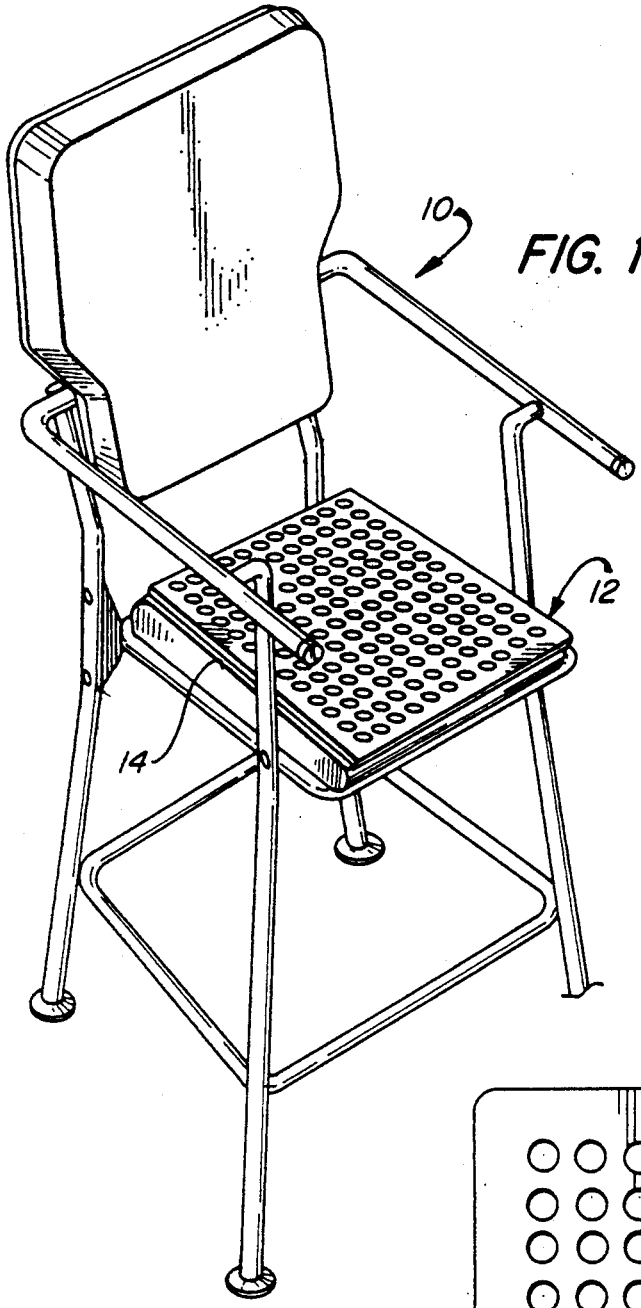
FIG. 1 is a perspective view showing an assembly embodying the present invention.
Figure 3:
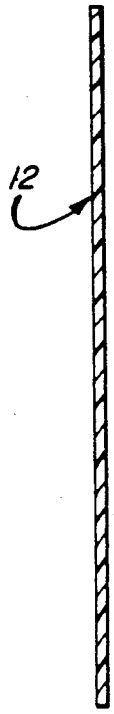
FIG. 3 is an edge view of the pad, taken along line 3—3 of FIG. 2.
Figure 2:
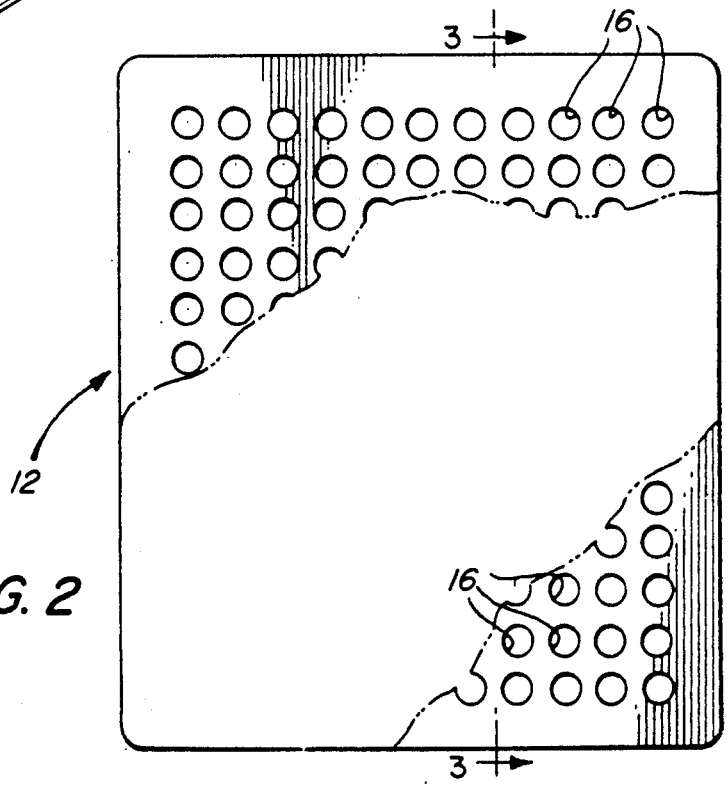
FIG. 2 is a plan view of the pad utilized therein, drawn to a scale greatly enlarged from that of FIG. 1.

Turning now in detail to FIG. 1 of the drawing, therein illustrated is an assembly embodying the present invention and consisting of a highchair, generally designated by the numeral 10, and a pad, generally designated by the numeral 12, freely (i.e., without fasteners, adhesives or other interconnecting means) disposed upon the upper surface of its seat portion 14. As best seen from FIGS. 2 and 3, the pad 12 is integrally formed from a single, thin piece of solid, non-cellular material, and it is of substantially rectangular peripheral configuration.

As can also be seen, the pad 12 has a 10 by 13 matrix of holes 16 formed through it, each hole 16 being formed with a minimum edge break, thereby creating a sharp peripheral edge at the junctures with the flat faces of the pad. This affords maximum interengagement of the supple material normally placed in contact with the pad and pressed thereagainst (e.g., a baby's diaper), and contributes significantly to the level of resistance to relative movement therebetween that is afforded. In this respect, it will be appreciated that the pad must have a certain minimal thickness (e.g., not less than about 0.06 inch) to produce the desired mechanical interengagement.

A specific embodiment of the invention employs a 0.063 inch thick slab of 40 durometer neoprene rubber, having a tensile strength of about 3000 pounds per square inch and edge dimensions of about 9.6 by 11.0 inches. The holes are disposed on 0.75 inch centers, with a 1.0 inch peripheral margin thereabout, and each has a diameter of approximately 0.5 inch.

As noted above, it is also important that the holes formed through the pad cumulatively constitute about 20 to 30 percent of the total area thereof (i.e., the projected area, not the total surface area), and ideally that proportion will be about 24 to 25 percent. This feature is important from several standpoints: it ensures that the pad will readily permit liquids and contaminating substances to pass through it, and it facilitates cleaning; taken with the required thickness limitations and the durometer value of the construction material, it ensures that the pad will readily conform to the contour of the seat 14 (as illustrated in FIG. 1), thereby producing maximum surface contact and slip resistance with the chair; and finally, it achieves those ends without undue compromise of the inherent strength and durability of the rubbery material from which the pad is fabricated.

Although the preferred material for construction of the pad will generally be a neoprene rubber, other natural and synthetic rubbery materials may of course also be employed, as long as they afford the necessary combination of properties, as herein set forth. For example, buna rubbers, and the enhanced neoprene product sold by E. I. DuPont de Nemours, Co. under the Viton trade designation, may advantageously be utilized in the practice of the invention. It should perhaps be emphasized that the material must be o solid form; in particular, it is found that foamed or other cellular structures are not satisfactory in the practice of the present invention, as lacking a desirable balance of density, conformability, strength and durability.

A primary criterion for the pad is of course that it exhibit a high coefficient of friction against the chair seat surface. Because wood (often varnished), synthetic polymers (e.g., vinyl plastics), and stainless steel and other metals may all be employed in the manufacture of the chair seat, it is obviously impractical to define the coefficient of friction applicable to all combinations and circumstances. However, it is believed that a fair generalization of the criterion is provided using a smooth wooden surface, in which case the material for the pad should be selected so as to afford a coefficient of friction of not less than unity, and preferably of about 1.2 or higher (all surfaces being of course clean and dry).

Thus, it can be seen that the present invention provides novel means for counteracting the tendency for occupants of chairs, and in particular babies in highchairs, to slip from upright seated positions. The means provided is simple, inexpensive, readily assembled and disassembled, and easy to use and clean, and yet it is durable and highly effective for its intended purposes.

Having thus described the invention, what is claimed is:

1. A chair assembly comprising, in combination:

a chair, including a seat portion having a smooth upper surface; and a thin, flat, compliant pad dimensioned and configured to substantially cover said upper surface of said seat portion, said pad being freely disposed upon said seat portion surface with one face thereof lying in direct contact therewith, said pad being about 0.06 to 0.125 inch thick, and being devoid of covering layers and integrally formed, as a single piece, from a solid, rubbery material having a durometer value of about 30 to 50, a tensile strength of at least about 2000 pounds per square inch, and a coefficient of friction of at least about unity, as determined in combination with a smooth surface of wood, said pad having an array of apertures formed therethrough and arranged substantially entirely thereover, each of said apertures being defined by a sharp peripheral edge at the juncture thereof with the other face of said pad, and providing an opening of about 0.05 to 0.3 square inch, said apertures cumulatively defining an open area constituting about 20 to 30 percent of the total area of said pad, whereby said pad inherently exhibits high levels of conformability to, and slip resistance with, said seat portion surface, good mechanical interengagability with supple members pressed upon said other face thereof, and good strength and durability characteristics.

2. The assembly of claim 1 wherein said apertures are round holes, each having a diameter of about 0.375 to 0.5 inch.

3. The assembly of claim 2 wherein said holes are equidistantly spaced from one another on perpendicular axes, to provide a rectangular matrix thereof.

4. The assembly of claim 3 wherein said holes are spaced on centers of about 0.75 inch.

5. The assembly of claim 2 wherein said open area constitutes about 24 to 25 percent of said total area.

6. The assembly of claim 1 wherein said rubbery material has a durometer value of about 40 and a tensile strength not in excess of about 4000 pounds per square inch, and wherein said coefficient of friction has a value of at least about 1.2, as so determined.

7. The assembly of claim 6 wherein said pad is of generally rectangular configuration with edge dimensions of about 9.5 to 12 inches by 11 to 13 inches.

8. The assembly of claim 6 wherein said rubbery material is neoprene.

9. The assembly of claim 1 wherein said chair is a baby's highchair.

10. A pad adapted for assembly with a chair having a seat portion with a smooth upper surface, to afford slip resistance therewith, said pad being thin, flat and compliant, and dimensioned and configured to substantially cover the upper surface of such a seat portion with one face of said pad lying in direct contact therewith, said pad being devoid of interconnecting means, being about 0.06 to 0.125 inch thick, and being devoid of covering layers and integrally formed, as a single piece, from a solid, rubbery material having a durometer value of about 30 to 50, a tensile strength of at least about 2000 pounds per square inch, and a coefficient of friction of at least about unity, as determined in combination with a smooth surface of wood, said pad having an array of apertures formed therethrough and arranged substantially entirely thereover, each of said apertures being defined by a sharp peripheral edge at the juncture thereof with the other face of said pad, and providing an opening of about 0.05 to 0.3 square inch, said apertures cumulatively defining an open area constituting about 20 to 30 percent of the total area of said pad, whereby said pad will inherently exhibit high levels of conformability and slip resistance with such a seat portion surface, good mechanical interengagability with supple means pressed upon said other face thereof, and good strength and durability characteristics.

11. The pad of claim 10 wherein said apertures are round holes, each having a diameter of about 0.375 to 0.5 inch, equidistantly spaced from one another on perpendicular axes to provide a rectangular matrix thereof, wherein said rubbery material has a durometer value of about 40 and a tensile strength not in excess of about 4000 pounds per square inch, and wherein said coefficient of friction has a value of at least about 1.2, as so determined.

12. The pad of claim 11 wherein said rubbery material is neoprene.

13. The pad of claim 12 wherein said holes are spaced on centers of about 0.75 inch, wherein said open area constitutes about 24 to 25 percent of said total area, and wherein said pad is of generally rectangular configuration with edge dimensions of about 9.5 to 12 inches by 11 to 13 inches.

* * * * *